US005661101A

United States Patent [19]

Washizu et al.

[11] Patent Number: 5,661,101

[45] Date of Patent: Aug. 26, 1997

[54] RECORDING MATERIAL

[75] Inventors: Shintaro Washizu; Hidenori Gotoh, both of Shizuoka, Japan

[73] Assignee: Fuji Photo Film Co., Ltd., Kanagawa, Japan

[21] Appl. No.: 659,435

[22] Filed: Jun. 6, 1996

[30] Foreign Application Priority Data

Jun. 19, 1995 [JP] Japan ..... 7-151470
Jan. 29, 1996 [JP] Japan ..... 8-013349

[51] Int. Cl.[6] ..... B41M 5/40

[52] U.S. Cl. ..... 503/226; 427/152; 503/200

[58] Field of Search ..... 427/152; 428/520; 503/200, 206

[56] References Cited

FOREIGN PATENT DOCUMENTS

| | | | |
|---|---|---|---|
| 1-272486 | 10/1989 | Japan | 503/227 |
| 1-288481 | 11/1989 | Japan | 503/227 |
| 4-232091 | 8/1992 | Japan | 503/227 |
| 4-348988 | 12/1992 | Japan | 503/214 |
| 5-262038 | 10/1993 | Japan | 503/214 |
| 6-48036 | 2/1994 | Japan | 503/214 |
| 6-88457 | 11/1994 | Japan | 503/227 |

*Primary Examiner*—Bruce H. Hess
*Attorney, Agent, or Firm*—Sughrue, Mion, Zinn, Macpeak & Seas

[57] ABSTRACT

A recording material is provided with, on a support, at least a coloring layer containing a first coloring component which is substantially colorless and a second coloring component which is substantially colorless and is colored by reacting with the first coloring component, wherein the coloring layer contains a polyvinyl alcohol resin having syndiotacticity of greater than or equal to 55 molar % as diad indication and a saponification degree of greater than or equal to 85 molar %. There is also disclosed a recording material having a protective layer provided on the coloring layer of the aforementioned recording material, wherein the polyvinyl alcohol resin having syndiotacticity of greater than or equal to 55 molar % as diad indication and a saponification degree of greater than or equal to 85 molar % is contained in at least one of the coloring layer and the protective layer. In particular, a modified polyvinyl alcohol having an ethylene-modified rate of 20 molar % to 1 molar % and a saponification rate of greater than or equal to 85 molar % is suitable. The present recording materials have the excellent water resistance, resistance to chemicals, running properties and manufacturing applicability.

7 Claims, No Drawings

RECORDING MATERIAL

BACKGROUND OF THE INVENTION

1. Field of the Invention

The present invention relates to a recording material, and more particularly, to a recording material having a coloring layer or having a coloring layer and a protecting layer, and having excellent water resistance, resistance to chemicals, running properties and manufacturing applicability.

2. Description of the Related Art

Pressure-sensitive paper, thermal-sensitive recording paper, photosensitive-pressure-sensitive paper, conduction-thermal recording paper, thermal transferring paper and the like are well-known as recording materials which use, as coloring components, a colorless electron donor dye and an electron acceptor compound (for details, see for example GB Patent No. 2,140,449, U.S. Pat. No. 4,480,052, U.S. Pat. No. 4,436,920, JP-B No. 60-23992, JP-A No. 57-179836, JP-A No. 60-123556, JP-A No. 60-123557 and the like). For example, thermal-sensitive recording papers using an electron donor dye precursor and an electron acceptor compound are disclosed in JP-B No. 45-14039, JP-B No. 43-4160 and the like. In addition, thermal-sensitive recording materials using a diazo compound are disclosed in JP-A No. 59-190886 and the like.

Further, thermal-sensitive recording materials having specific binders are disclosed in JP-A No. 1-288481, JP-B No. 6-88457, JP-A No. 1-272486 and JP-A No. 4-2-232091.

Recently, thermal-sensitive recording systems have been applied to many fields such as facsimiles, printers, labels, meter checking terminal apparatuses, devices for medical image output, prepaid cards and the like, and have a variety of uses. Accordingly, use of thermal-sensitive recording papers at home or outdoors has increased. In such cases, when a thermal-sensitive recording paper is handled with wet hands or the coated surface is made wet by rain or snow, adhesion or peeling of the thermal-sensitive paper may occur. Therefore, from a practical standpoint, there is an increasing need for recording papers to be water resistant.

Many attempts have been tried to eliminate the above drawback. In particular, the sticking of the recording paper and dregs greatly affect the running properties, and are believed to be caused by complicated factors such as the strength or glass transition point of the resin film used for the binder. However, no effective means have been proposed to solve this drawback. In addition, in order to improve the water resistance, there have been proposed a method using a cross-liking agent such as formalin, glyoxal or the like as a water resistance agent, and a method of cross-linking polyvinyl alcohol (PVA) by using a metallic chelating compound. However, since the drying-treatment temperature and the heat-treatment temperature are limited to relatively low temperatures in light of the properties of the coloring substance, the cross-linking is insufficient and, as a result, the water resistance of the recording paper is insufficient.

SUMMARY OF THE INVENTION

An object of the present invention is to provide a recording material having excellent water resistance, resistance to chemicals, running properties and manufacturing applicability.

The above object of the present invention is accomplished by a recording material provided with, on a support, at least a coloring layer containing a first coloring component which is substantially colorless and a second coloring component which is substantially colorless and is colored by reacting with the first coloring component, wherein the coloring layer contains a polyvinyl alcohol resin having syndiotacticity of greater than or equal to 55 molar % as diad indication and a saponification degree of greater than or equal to 85 molar %.

The above object of the present invention is also accomplished by a recording material provided with, on a support, at least a coloring layer containing a first coloring component which is substantially colorless and a second coloring component which is substantially colorless and is colored by reacting with the first coloring component, and a protective layer provided on the coloring layer and having a pigment and a binder as main components, wherein at least one of the coloring layer and the protecting layer contains a polyvinyl alcohol resin having syndiotacticity of greater than or equal to 55 molar % as diad indication and a saponification degree of greater than or equal to 85 molar %.

DESCRIPTION OF THE PREFERRED EMBODIMENT

The present invention is explained in detail hereinafter. The recording material of the present invention is (1) a recording material provided with, on a support, at least a coloring layer containing a first coloring component which is substantially colorless and a second coloring component which is substantially colorless and is colored by reacting with the first coloring component, and (2) a recording material provided with, on a support, at least a coloring layer containing a first coloring component which is substantially colorless and a second coloring component which is substantially colorless and is colored by reacting with the first coloring component, and a protecting layer provided on the coloring layer and having a pigment and a binder as main components.

In recording material (1), the coloring layer contains a polyvinyl alcohol resin having syndiotacticity of greater than or equal to 55 molar % as diad indication and a saponification degree of greater than or equal to 85 molar %. In recording material (2), at least one of the coloring layer and the protecting layer contains a polyvinyl alcohol resin having syndiotacticity of greater than or equal to 55 molar % as diad indication and a saponification degree of greater than or equal to 85 molar %. Therefore, the coloring layer or the protecting layer may contain a polyvinyl alcohol resin having syndiotacticity of greater than or equal to 55 molar % as diad indication and a saponification degree of greater than or equal to 85 molar %, or both the coloring layer and the protective layer may contain a polyvinyl alcohol resin having syndiotacticity of greater than or equal to 55 molar % as diad indication and a saponification degree of greater than or equal to 85 molar %.

Syndiotacticity in the present recording material (hereinafter referred to as "syndiotactic property") refers to dyadtacticity, that is, syndiotacticity (s) calculated according to the following equations:

$$i=I+H/2,\ s=S+H/2$$

wherein triadtacticities are as follows: I is isotacticity, H is heterotacticity and S is syndiotacticity, and wherein i is isotacticity and I, H and S are obtained by measuring the NMR spectrum of hydroxide proton of polyvinyl alcohol dissolved in deuterated dimethyl sulfoxide.

This syndiotactic polyvinyl alcohol is obtained by saponifying a copolymer having a vinyl ester unit represented by the following general formula (1):

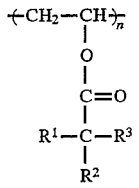

(1)

wherein n represents an arbitrary number of the repeating unit, $R^1$, $R^2$ and $R^3$ represent hydrogen or hydrocarbon group, or $R^2$ and $R^3$ may be linked to form a cyclic hydrocarbon group, or $R^1$, $R^2$ and $R^3$ may be linked to form a cyclic hydrocarbon group.

Examples of the vinyl ester unit are units of: vinyl trialkylacetates such as vinyl bivalate, vinyl dimethylethylacetate, vinyl dimethylpropylacetate, vinyl dimethylethylacetate, vinyl triethylacetate, vinyl tripropylacetate, vinyl birsachicate and the like, vinyl dialkylacetates such as vinyl dimethylacetate, vinyl diethylacetate and the like, and cycloalkyls such as vinyl methylcyclohexylacetate, vinyl 1-norbornanecarboxylate, vinyl 3-noradamantanecarboxylate and the like. Among polymers having these vinyl ester units, polymers having vinyl bivalate and vinyl birsachicate which easily lead to high polymerization degree polymers and are easily saponified are preferable.

In the syndiotactic polyvinyl alcohol, in order to attain sufficient water resistance and the like, the syndiotacticity (s) is greater than or equal to 55 molar % as diad indication, preferably 55.0 to 70 molar %, more preferably 55.8 to 65 molar %. When the syndiotactic property is less than 55 molar %, sufficient water resistance and resistance to chemicals cannot be obtained. When the syndiotactic property is too high, the water solubility is decreased. The polymerization degree of the syndiotactic polyvinyl alcohol is preferably 300 to 40000 and desirably 500 to 2000 from the viewpoint of the coating properties, water resistance and the like. The saponification degree of the syndiotactic polyvinyl alcohol is preferably greater than or equal to 85 molar %, more preferably greater than or equal to 98 molar %. When the saponification degree is less than 85 molar %, sufficient water resistance, resistance to chemicals and the like cannot be obtained.

The syndiotactic polyvinyl alcohol in the present invention is desirably polyvinyl alcohol obtained by saponifying a random copolymer having a vinyl unit represented by the following general formula (2):

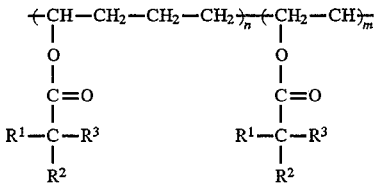

(2)

wherein each of m and n represents an arbitrary number of the repeating unit satisfying the equation; $3 \leqq m/n \leqq 98$, $R^1$, $R^2$ and $R^3$ represent hydrogen or hydrocarbon group, or $R^2$ and $R^3$ may be linked to form a cyclic hydrocarbon group, or $R^1$, $R^2$ and $R^3$ may be linked to form a cyclic hydrocarbon group.

Among the syndiotactic polyvinyl alcohols, ethylene-modified polyvinyl alcohol, which is a random polymer composed of a vinyl alcohol monomer component of polyvinyl alcohol and ethylene monomer at a ratio of 80:20–99:1, is desirable. In the case of ethylene-modified polyvinyl alcohol, in order to attain water solubility and sufficient water resistance, the ethylene-modified rate is desirably 20 molar % (that is, the ratio of the vinyl alcohol monomer component and the ethylene monomer is 80:20) to 1 molar % (the ratio of the vinyl alcohol monomer component and the ethylene monomer is 99:1), and more desirably 5 to 10 molar %. In the case of ethylene-unmodified polyvinyl alcohol, sufficient water resistance and resistance to chemicals cannot be obtained. When the ethylene-modified rate exceeds 20 molar %, water solubility decreases.

The syndiotactic polyvinyl alcohol may be further modified with other functional groups as long as they have no adverse effects on the properties and the coating solution stability. Examples of other functional groups are carboxyl group, terminal alkyl group, amino group, sulfonic acid group, terminal thiol group, silanol group, amide group and the like. In order to impart solubility to high syndiotactic polyvinyl alcohol, carboxyl group-modification, amino group-modification, sulfonic acid-modification and the like are effective.

The protecting layer may contain, in addition to the syndiotactic polyvinyl alcohol, other binder components, if needed. Examples of water soluble polymers used as the binder are methylcellulose, carboxymethylcellulose, hydroxyethylcellolose, starch, gelatin, gum arabic, casein, styrene-maleic anhydride copolymer hydrolysate, ethylene-maleic anhydride copolymer hydrolysate, isobutylene-maleic anhydride copolymer hydrolysate, polyvinyl alcohol, modified polyvinyl alcohol, polyacrylamide, and the like. Since the use of a water soluble polymer may decrease the water resistance, attention should be paid to the amount and the type of water soluble polymer used.

The water soluble binder is generally synthetic rubber latex or synthetic rubber emulsion, and examples thereof are styrene-butadiene rubber latex, acrylonitrile-butadiene rubber latex, methyl acrylate-butadiene rubber latex, vinyl acetate emulsion and the like. The amount of the binder to be used is 10 to 500% by weight, preferably 50 to 400% by weight relative to the pigment contained in the protective layer.

In order to further improve the water resistance, a cross-linking agent and a catalyst for promoting the reaction of the cross-linking agent may be effectively used. Examples of the cross-linking agent are epoxy compound, blocked isocyanate, vinylsulfone compound, aldehyde compound, methylol compound, boric acid, carboxylic anhydride, silane compound, chelate compound, and halogenated compound. A cross-linking agent which can adjust the pH of a coating solution to 6.0 to 7.5 is preferable. As the catalysts, well-known materials such as acid, metal salt and the like may be used, and a preferable catalysts can similarly adjust the pH of the coating solution to 6.0 to 7.5.

An epoxy compound having two- or more functional groups may be used, and examples thereof are dibromophenyl glycidyl ether, dibromoneopentylglycol diglycidyl ether, epoxycresol novolac resin emulsion, modified bisphenol A type epoxy emulsion, adipic diglycidyl ester, o-phthalic diglycidyl ester, hydroquinone diglycidyl ether, bisphenol S glycidyl ether, terephthalic diglycidyl ether, glycidyl phthalimide, propylenepolypropylene glycol diglycidyl ether, polytetramethylene glycol diglycidyl ether, allyl glycidyl ether, 2-ethylhexyl glycidyl ether, phenyl glycidyl ether, phenol$(EO)_5$ glycidyl ether, p-tert-butylphenyl glycidyl ether, lauryl alcohol $(EO)_{15}$ glycidyl ether, glycidyl ether of a mixture of alcohols having 12 to 13 carbon atoms, glycerol polyglycidyl ether, trimetylolpropane polyglycidyl ether, resorcin diglycidyl ether, neopentyl glycol diglycidyl ether, 1,6-hexanediol diglycidyl ether, ethylenepolyethylene glycol diglycidyl ether, sorbitol polyglycidyl ether, sorbitan polyglycidyl ether, polyglycerol polyglycidyl ether, pentaerythritol polyglycidyl ether, diglycerol polyglycidyl ether, triglycidyl-tris(2-hydroxyethyl)isocyanurate and the like. Among these epoxy compounds, glycidyl ethers are appropriate.

The epoxy equivalent in the effective epoxy compounds in the present invention is desirably 70 to 1000 WPE. An epoxy equivalent exceeding 1000 WPE is not preferable since it becomes difficult to impart water resistance to a recording material.

Blocked isocyanate refers to an isocyanate whose terminal isocyanate group(s) are masked with a blocking agent. Examples of the blocked isocyanate are (a) an isocyanate compound wherein a block part of a hydrophilic group of carbamoyl sulfonate group ($—NHCOSO_3^-$) is formed at a terminus thereof and the active isocyanate group(s) are thereby blocked, (b) an isocyanate compound wherein the active isocyanate group(s) are blocked using isopropylidenemalonate, this blocked isocyanate being obtained by reaction of HDI isocyanurate, isopropylidenemalonate and triethylamine, (c) an isocyanate compound wherein the active isocyanate group(s) are blocked with phenol or the like. When the blocked isocyanate is mixed with the syndiotactic polyvinyl alcohol and heated, the water resistance of the syndiotactic polyvinyl alcohol is attained by cross-linking and improving the syndiotactic polyvinyl alcohol.

Further, vinyl sulfone compounds described in JP-A No. 53-57257, JP-A No. 53-41221, JP-B No. 49-13563, JP-B No. 47-24259 and the like may be used.

Examples of the aldehyde compound are monoaldehydes such as formaldehyde, acetaldehyde and the like, and polyvalent aldehydes such as glyoxal, glutaraldehyde, dialdehyde-starch and the like. Examples of the methylol are methylolmelamine, methylolurea and the like. In the syndiotactic polyvinyl alcohol, an aldehyde compound is particularly suitable for the cross-linking agent.

The amount of the cross-linking agent to be used is desirably 3 to 50 parts by weight relative to 100 parts of the syndiotactic polyvinyl alcohol. When the amount of the cross-linking agent is less than 3 parts by weight, the degree of improvement by cross-linking is low and, as a result, the water resistance and the resistance to chemicals become insufficient. On the other hand, when the amount exceeds 50 parts by weight, the coating solution stability is decreased.

The pigment used in the protective layer may be any organic or inorganic pigment. Examples of the pigment are calcium carbonate, aluminum hydroxide, barium sulfate, titanium oxide, talc, pyrophyllite, kaolin, calcined kaolin, amorphous silica, urea-formalin resin powder, polyethylene resin powder, benzoguanamine resin powder and the like. These may be used alone or in a combination thereof.

A coating solution for forming the protective layer in the present invention is obtained by mixing a dispersion of the above pigment, a syndiotactic polyvinyl alcohol, a cross-linking agent, a catalyst and the like. If needed, a releasing agent, a surfactant, a wax, a water repellent, and the like may be incorporated. The resulting coating solution for forming the protective layer is coated on the thermal-sensitive coloring layer using an apparatus such as bar coater, an air knife coater, a blade coater, a curtain coater or the like, and is then dried to obtain the protecting layer in the present invention. The protective layer may be coated simultaneously when the coloring layer is coated. Alternatively, the thermal-sensitive coloring layer may be coated and then dried and, thereafter, the protective layer may be coated thereon. The dry-state coating amount of the protective layer is preferably 0.5 to 5 $g/m^2$, and more preferably 0.8 to 2 $g/m^2$. When the coating amount is large, the thermal sensitivity is remarkably decreased. When the coating amount is too small, water resistance cannot be maintained. After coating the protective layer, calendering treatment may be carried out if needed.

The coloring layer in the present invention contains at least a first coloring component which is substantially colorless and a second coloring component which is substantially colorless and is colored by reacting with the first coloring component. The first coloring component and the second coloring component used in the present invention are components which generate a coloring reaction when contacted with each other. Examples of combinations of the first coloring component and the second coloring component are as follows:

(i) combination of a photodegradable diazo compound and a coupler, (ii) combination of an electron donor dye precursor and an electron acceptor compound, (iii) combination of an organic metal salt such as silver behenate, silver stearate and the like and a reducing agent such as protocatechuic acid, spiroindane, hydroquinone and the like, (iv) combination of a long-chain fatty acid salt such as ferric stearate, ferric myristylate and the like and a phenol such as tannic acid, gallic acid, ammonium salicylate and the like, (v) combination of a heavy metal salt of an organic acid, such as nickel, cobalt, lead, copper, iron, mercury or silver salt of acetic acid, stearic acid, palmitic acid and the like and an alkaline earth metal sulfide such as calcium sulfide, strontium sulfide, potassium sulfide and the like, or combination of any of the above heavy metal salts of an organic acid and an organic chelating agent such as s-diphenylcarbazide, diphenylcarbazone and the like, (vi) combination of a heavy metal sulfate such as silver, lead, mercury or sodium sulfate and a sulfur compound such as Na-tetrathionate, sodium thiosulfate, thiourea and the like, (vii) combination of a ferric salt of a fatty acid such as ferric stearate and the like and an aromatic polyhydroxy compound such as 3,4-dihyroxytetraphenylmethane and the like, (viii) combination of a metal salt of an organic acid such as oxalate, mercury oxalate and the like and an organic polyhydroxy compound such as polyhydroxy alcohol, glycerin, glycol and the like, (ix) combination of a ferric salt of a fatty acid such as ferric pelargonate, ferric laurate and the like and thiocetylcarbamide or isothiocetylcarbamide derivative, (x) combination of a lead salt of an organic acid such as lead capronate, lead pelargonate, lead behenate and the like and a thiourea derivative such as ethylenethiourea, N-dodecylthiourea and the like, (xi) combination of a heavy metal salt of a higher fatty acid such as ferric stearate, copper stearate and the like and zinc dialkyldithiocarbamate, (xii) combination of resorcin and a nitroso compound, which forms an oxazine dye, (xiii) combination of a formazane compound and a reducing agent and/or a metal salt.

Among the above combinations, (i) the combination of a photodegradable diazo compound and a coupler, (ii) the combination of an electron donor dye precursor and an electron acceptor compound, and (iii) the combination of an organic metal salt and a reducing agent are preferable, and combinations (i) and (ii) are particularly preferable.

The photodegradable diazo compound in the combination of a photodegradable diazo compound and a coupler is a diazo compound which is colored in a desired hue by reacting with a color former called a coupling component and described below, and which is degraded when irradiated with light having a particular wavelength and which can be no longer colored when the coupling component acts thereon.

The hue in this coloring system depends upon the diazo dye produced by reaction of the diazo compound and the coupling component. Therefore, as is well known, the coloring hue can be easily changed by altering the chemical structure of the diazo compound or altering that of the coupling component. The coloring hue can be arbitrarily changed by varying the combination of the diazo compound and the coupling component.

The photodegradable diazo compound in the present invention refers mainly to an aromatic diazo compound, more particularly, aromatic diazonium salt, diazosulfonate compound and diazoamino compound.

The diazonium salt is a compound represented by the general formula $ArN_{2+}X^-$ (wherein Ar represents a substituted or unsubstituted aromatic part, $N_2^+$ represents a diazonium group and $X^-$ represents an acid anion).

The photodegradation wavelength of the diazonium salt is usually thought to be the maximum absorption wavelength thereof. In addition, the maximum absorption wavelength is known to vary from around 200 nm to around 700 nm depending upon the chemical structure of the diazonium salt ("Photodegradation and Chemical Structure of Photosensitive Diazonium Salt", Takahiro Kadota and Masao Yamaoka, Journal of the Japan Photographic Society, 20(4):197–205 (1965)). That is, when the diazonium salt is used as a photodegradable compound, it degrades at a particular wavelength depending upon its chemical structure, and the hue of a dye when coupling-reacted with the same coupling component is changed by altering the chemical structure of the diazonium salt.

Many diazosulfonate compounds which can be used in the present invention are known and can be obtained by treating the respective diazonium salts with a sulfite.

Examples of the diazoamino compound are compounds, whose diazo group(s) are coupled with dicyandiamide, sarcosine, methyltaurine, N-ethylanthranic acid-5-sulfonic acid, monoethanolamine, diethanolamine, guanidine or the like.

These diazo compounds are described in detail, for example, in JP-A No. 2-136286.

As a light source for photodegradation of the diazo compound, various light sources which emit light having the desired wavelength can be used, such as various fluorescent tubes, xenon lamp, xenon flash lamp, various pressurized mercury lamps, photographic flash, stroboscope or the like. In order to make a photo-fixing zone compact, the light source part and the exposure part may be separated by using an optical fiber.

Examples of the coupling component which is coupled with the diazo compound used in the present invention to form a dye are 2-hydroxy-3-naphthoic acid anilide, resorcin and others described in JP-A No. 62-146678.

By using two or more coupling components, an image having an arbitrary tint can be obtained. Therefore, the present invention is not limited to a monochromatic thermal-sensitive recording material.

Since the coupling reaction of these diazo compounds with the coupling component occurs easily in a basic condition, a basic compound may be added in the thermal-sensitive layer.

As the basic compound, a water slightly-soluble or water-insoluble basic compound or a basic compound which produces an alkali upon heating are used. Examples thereof are nitrogen-containing compounds such as inorganic or organic ammonium salt, organic amine, amide, urea and thiourea and derivatives thereof, thiazoles, pyrroles, pyrimidines, piperazines, guanidines, indoles, imidazoles, imidazolidines, triazoles, morpholines, piperidines, amidines, farmazines, pyridines and the like. Embodiments of these compounds are described in JP-A No. 61-291183. In addition, a combination of basic compounds may be used.

The electron donor dye precursor in the combination of an electron donor dye precursor and an electron acceptor compound includes, but is not limited to, compounds having the properties of donating an electron or accepting a proton from an acid or the like to produce the color. Such compounds are usually colorless and have a partial skeleton such as lactone, lactam, sultone, spiropyran, ester, amide and the like. When the compounds contact the electron acceptor compound which is a color former, these partial skeletons are ring-opened or cleavaged.

Examples of the color former are crystal violet lactone, benzoyl leuco-methylene blue, malachite green lactone, rhodamine B lactam, 1,3,3-trimethyl-6'-ethyl-8'-butoxyindolinobezospiropyran and the like. Examples of the electron acceptor compound for the color former are acidic compounds such as phenol compound, organic phosphonic acid compound, fatty carboxylic acid compound and the like.

Examples of the phenol compound are p-(dodecylthio)phenol, p-(tetradecylthio)phenol, p-(hexadecylthio)phenol, p-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecylcarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, gallic hexadecylester, gallic octadecylester, gallic eicosylester, gallic docosylester, gallic tetracosylester and the like.

Examples of the organic phosphonic acid compound are dodecyl phosphonate, tetradodecyl phosphonate, hexadecyl phosphonate, octadecyl phosphonate, eicosyl phosphonate, docosyl phosphonate, tetracosyl phosphonate, hexacosyl phosphonate, octacosyl phosphonate and the like.

Examples of the fatty carboxylic acid are α-hydroxydecanoic acid, α-hydroxytetradecanoic acid, α-hydroxyhexadecanoic acid, α-hydroxyoctadecanoic acid, α-hydroxypentadecanoic acid, α-hydroxyeicosanoic acid, α-hydroxydocosanoic acid, α-hydroxytetracosanoic acid, α-hydroxyhexacosanoic acid, α-hydroxyoctacosanoic acid, 2-bromohexadecanoic acid, 2-bromoheptadecanoic acid, 2-bromooctadecanoic acid, 2-bromoeicosanoic acid, 2-bromotetracosanoic acid, 3-bromooctadecanoic acid, 3-bromoeicosanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanoic acid, 2-fluorodocosanoic acid, 2-iodooctadecanoic acid, 3-iodohexadecanoic acid, 3-iodooctadecanoic acid, perfluorooctadecanoic acid, 2-oxododecanoic acid, 2-oxotetradecanoic acid, 2-oxohexadecanoic acid, 2-oxooctadecanoic acid, 2-oxoeicosanoic acid, 2-oxotetracosanoic acid, 3-oxododecanoic acid, 3-oxotetradodecanoic acid, 3-oxohexadecanoic acid, 3-oxooctadecanoic acid, 3-oxoeicosanoic acid, 3-oxotetracosanoic acid, 4-oxohexadecanoic acid, 4-oxooctadecanoic acid, 4-oxodocosanoic acid, dodecylmalic acid, tetradecylmalic acid, hexadecylmalic acid, octadecylmalic acid, eocodecylmalic acid, docosylmalic acid, tetracosylmalic acid, dodecylthiomalic acid, tetradecylthiomalic acid, hexadecylthiomalic acid, octadecylthiomalic acid, eicosyldecylthiomalic acid, docosylthiomalic acid, tetracosylthiomalic acid, dodecyldithiomalic acid, tetradecyldithiomalic acid, hexadecyldithiomalic acid, octadecyldithiomalic acid, eicosyldithiomalic acid, docosyldithiomalic acid, tetracosyldithiomalic acid, dodecylbutanedioic acid, tridecylbutanedioic acid, tetradecylbutanedioic acid, pentadecylbutanedioic acid, octadecylbutanedioic acid, eicosylbutanedioic acid, docosylbutanedioic acid, 2,3-dihexadecylbutanedioic acid, 2,3-dioctadecylbutanedioic acid, 2-methyl-3-dodecylbutanedioic acid, 2-methyl-3-tetradecylbutanedioic acid, 2-methyl-3-hexadecylbutanedioic acid, 2-ethyl-3-dodecylbutanedioic acid, 2-propyl-3-decylbutanedioic acid, 2-octyl-3-hexadecylbutanedioic acid, 2-tetradecyl-3-octadecyldiacid, dodecylmalonic acid, tetradecylmalonic acid, hexadecylmalonic acid, octadecylmalonic acid, eicosylmalonic acid, docosylmalonic acid, tetracosylmalonic acid, didodecylmalonic acid, ditetradecylmalonic acid, dihexadecylmalonic acid, dioctadecylmalonic acid, dieicosylmalonic acid, didocosylmalonic acid, methyloctadecylmalonic acid, methyleicosylmalonic acid, methyldocosylmalonic acid, methyltetracosylmalonic acid, ethyloctadecylmalonic acid, ethyleicosylmalonic acid, ethyldocosylmalonic acid, ethyltetracosylmalonic acid, 2-dodecyl-pentanedioic acid, 2-hexadecyl-pentanedioic acid, 2-octadecyl-pentanedioic acid, 2-eicosyl-pentanedioic acid, 2-docosyl-pentanedioic acid, 2-dodecyl-hexanedioic acid, 2-pentadecyl-hexanedioic acid, 2-octadecyl-hexanedioic acid, 2-eicosyl-hexanedioic acid, 2-docosyl-hexanedioic acid and the like.

When the combination of an electron donor dye precursor and an electron acceptor compound is used, a thermal-sensitive recording material with which color extinction and color development can be reversibly repeated may be obtained (JP-A No. 5-124360).

Further, a combination of a di- or triarylmethane dye precursor (thiolactone) and a organic silver salt is suitable (JP-A No. 63-501941).

Examples of the organic metal salt in the combination of an organic metal salt and a reducing agent are a silver salt of a long-chain aliphatic carboxylic acid such as silver laurate, silver myristate, silver palmitate, silver stearate, silver arachidate, silver behenate and the like, a silver salt of a compound having imino group such as benzotriazole silver salt, benzimidazole silver salt, carbazole silver salt, phthalazinone silver salt and the like, a silver salt of a sulfur-containing compound such as s-alkylthioglycolate and the like, a silver salt of an aromatic carboxylic acid such as silver benzoate, silver phthalate and the like, a silver salt of a sulfonic acid such as silver ethanesulfonate and the like, a silver salt of a sulfinic acid such as silver o-toluenesulfinate and the like, a silver salt of a phosphoric acid such as silver phenylphosphate and the like, silver barbiturate, silver saccharate, a silver salt of salicylaldoxime and the like, as well as a mixture thereof. Among these compounds, a silver salt of a long-chain aliphatic fatty acid, particularly silver behenate, is preferable. In addition, behenic acid may be used together with silver behenate.

In the present invention, a reducing agent can be appropriately used based on the description of JP-A No. 53-1020, page 227, lower left column, line 14 to page 229, upper right column, line 11. Preferable examples thereof are mono-, bis-, tris- or tetrakisphenols, mono- or bisnaphthols, di- or polyhydroxynaphthalenes, di- or polyhydroxybenzenes, hydroxymonoethers, ascorbic acids, 3-pyrazolidones, pyrazolines, pyrazolones, reducing sugars, phenylenediamines, hydroxylamines, reductons, hydroxamines, hydrazides, amidoximes, N-hydroxyureas and the like. Among these compounds, aromatic organic reducing agents such as polyphenols, sulfonamidephenols and naphthols are particularly preferable.

Examples of methods for using the coloring component include (1) a method by solid dispersion, (2) a method by emulsion dispersion, (3) a method by polymer dispersion, (4) a method by latex dispersion, (4) a method by microcapsulation and the like. Among these methods, a method by microcapsulation is preferable.

When the coloring component is used in a method by solid dispersion, the coloring component together with an aqueous solution of a water-soluble polymer, such as polyvinyl alcohol or the like, are dispersed to a diameter of a few microns or less by using a ball mill, sand mill or the like. The dispersion is mixed after dispersion. If needed, oil absorbing pigment, binder, wax, metallic soap, antioxidant, ultraviolet absorbing agent, surfactant, antistatic agent, anti-foaming agent, electro-conducting material, fluorescent dye, colorant and the like may be added thereto to obtain a coating solution for a thermal-sensitive coloring layer.

When the coloring component is used in a method by emulsion dispersion, an oily solution containing the coloring component is added to an aqueous solution of a water-soluble polymer, followed by emulsion dispersion with a colloid mill, a homogenizer or the ultrasound. An emulsion or latex of a hydrophobic polymer can be used together with a water-soluble polymer such as polyvinyl alcohol. Examples of the water-soluble polymer are polyvinyl alcohol, silanol-modified polyvinyl alcohol, carboxy-modified polyvinyl alcohol, amino-modified polyvinyl alcohol, itaconic acid-modified polyvinyl alcohol, styrene-maleic anhydride copolymer, butadiene-maleic anhydride copolymer, ethylene-maleic anhydride copolymer, isobutylene-maleic anhydride copolymer, polyacrylamide, polystyrenesolfonic acid, polyvinylpyrrolidone, ethylene-acrylic acid copolymer, gelatin and the like. Among these, carboxy-modified polyvinyl alcohol is preferable. Examples of the emulsion or latex of a hydrophobic polymer are styrene-butadiene copolymer, carboxy-modified styrene-butadiene copolymer, acrylonitrile-butadiene copolymer and the like. If needed, a known surfactant may be added thereto.

A known microcapsulation method can be used as the method for microcapsulation of the coloring component. That is, the coloring component and a microcapsule wall precursor are dissolved in a water slightly-soluble or water-insoluble organic solvent, the solution is added to an aqueous solution of a water-soluble polymer, followed by emulsion dispersion using a homogenizer or the like. Then, the temperature is raised to form a polymer which is the wall membrane of the microcapsule at the oil/water interface, and a microcapsule is obtained. Examples of the polymer for the microcapsule wall membrane are polyurethane resin, polyurea resin, polyamide resin, polyester resin, polycarbonate resin, aminoaldehyde resin, melamine resin, polystyrene resin, styrene-acrylate copolymer resin, styrene-methacrylate copolymer resin, gelatin, polyvinyl alcohol and the like. Among the resulting microcapsules, a microcapsule having a wall made of polyurethane and/or polyurea resins is preferable.

A microcapsule having a wall made of polyurethane and/or polyurea resins is prepared by mixing a microcapsule wall precursor such as polyvalent isocyanate or the like into a core substance to be microcapsulated, emulsifying the mixture in an aqueous solution of a water-soluble polymer such as polyvinyl alcohol or the like, then raising the solution temperature to cause a polymer forming reaction at the droplet interface.

Examples of the polyvalent isocyanate are diisocyanates such as m-phenylenediisocyanate, p-phenylenediisocyanate, 2,6-tolylenediisocyanate, 2,4-tolylenediisocyanate, naphthalene-1,4-diidocyanate, diphenylmethane-4,4'-diisocyanate, 3,3'-diphenylmethane-4,4'-diisocyante, xylene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclohexylene-1,2-diisocyanate, cyclohexylene-1,4-diisocyanate and the like, treiisocyanates such as 4,4',4"-triphenylmethanetriisocyanate, toluene-2,4,6-triisocyanate and the like, tetraisocyanates such as 4,4'-dimethyldiphenylmethane-2,2',5,5'-tetraisocyanate and the like, isocyanate prepolymers such as adduct of hexamethylenediisocyante and trimethylolpropane, adduct of 2,4-tolylenediisocyanate and trimethylolpropane, adduct of xylylenediisocyanate and trimethylolpropane, adduct of tolylenediisocyanate and hexanetriol and the like. A combination of these polyvalent isocyanates may be used, if needed. Among these polyvalent isocyanates, polyvalent isocyanates having three or more isocyanate groups are particularly preferable.

For dissolving the coloring component in the organic solvent in microcapsulation method, the oil described for emulsion dispersion can be used. Similarly, the same water-soluble polymer as that described for emulsion dispersion can be used in microcapsulation method. The diameter of the microcapsule is preferably 0.1 to 1.0 μm, more preferably 0.2 to 0.7 μm.

In order to improve the thermal response in the present recording material, a thermally meltable substance (hereinafter referred to as "sensitizer") may be contained in any layer in the thermal-sensitive recording material. Examples of the sensitizer are benzyl p-benzyloxybenzoate, β-naphthyl-benzyl ether, stearic amide, stearylurea, p-benzylbiphenyl, di(2-methylphenoxy)ethane, di(2-methoxyphenoxy)ethane, β-naphthol-(p-methylbenzyl) ether, α-naphthyl-benzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy)ethane, 1-phenoxy-2-(4-chlorophenoxy) ethane, 1,4-butanediolphenyl ether, diethylene glycol-bis(4-methoxyphenyl) ether, 4-ethoxyphenyl-p-chlorobenzyl ether, 1-(4-methoxyphenoxy)-2-phenoxy-propane, 1,3-bis (4-methoxyphenoxy) propane, 3-methyl-4-chlorophenyl-p-methoxybenzyl ether, 3,5-dimethyl-4-chlorophenyl-p-methoxybenzyl ether, 4-chlorophenyl-p-methoxybenzyl ether, 1-phenoxy-2-(4-methoxyphenoxy)propane, dibenzyl oxalate ester, di(p-methylbenzyl) oxalate ester and the like. These sensitizers may be used alone or in a mixture thereof. For obtaining a sufficient thermal response, the sensitizer may be added to disperse in either of the coloring components or in both of the coloring components. Alternatively, a thermal eutectic mixture with the coloring component may be prepared and cooled and, thereafter, may be dispersed.

As the binder, compounds having a water-solubility of greater than or equal to 5% by weight at 25° C. are preferable. Examples of the binder are polyvinyl alcohol (including polyvinyl alcohol modified with carboxy, itaconic acid, maleic acid, silica, amino group or the like), methylcellulose, carboxymethylcellulose, starch (including modified starch), gelatin, gum arabic, casein, styrene-maleic anhydride copolymer hydrolysate, polyacrylamide, saponified vinyl acetate-polyacrylic acid copolymer and the like. These binders are used not only for dispersion but also for improving the membrane strength. For the purpose of improving the membrane strength, the latex binder of a synthetic polymer such as styrene-butadiene copolymer, vinyl acetate copolymer, acrylonitrile-butadiene copolymer, methyl acrylate-butadiene copolymer, polyvinylidene chloride and the like may be used together with the above binder. If needed, a cross-linking agent for the binder may be added thereto depending upon the type of the binder.

Examples of the pigment are calcium carbonate, barium sulfate, lithopone, pyrophyllite, kaolin, calcined kaolin, silica, amorphous silica and the like. Examples of the metallic soap are metal salts of higher fatty acids such as zinc stearate, zinc myristrate, calcium stearate, aluminum stearate and the like.

Examples of the wax are montan wax, paraffin wax, carnauba wax, microcrystalline wax, polyethylene wax and the like. The resulting coating solution for the thermal-sensitive layer is coated on a high grade paper, a high grade paper having a subbing layer, a synthetic paper, a plastic film or the like, is dried and treated by calendering for smoothness, so as to obtain the object thermal-sensitive recording material. Upon this, a support having smoothness according to JIS-8119 of greater than or equal to 500 seconds, particularly greater than or equal to 800 seconds is preferably used from the standpoint of dot reproducibility. In order to obtain a support having smoothness greater than or equal to 500 seconds, the following means may be used: (1) a support having high smoothness such as synthetic paper, plastic film or the like is used, (2) a subbing layer having a pigment as a main component is provided on the support, (3) the smoothness of the support is improved by supercalendering or the like.

If needed, a back coat layer may be provided on the surface of the support opposite to the coloring layer. Any known back coat layer for the recording material can be used. When the above syndiotactic polyvinyl alcohol and, if needed, a cross-linking agent or the like are contained in this back coat layer, advantages such as water resistance and the like can be further improved.

The following Examples and Comparative Examples further illustrate the present invention in detail but are not to be construed to limit the scope thereof. The concentration used in Examples is % by weight.

EXAMPLE 1

20 g of 2-anilino-3-methyl-6-N-ethyl-N-tetrahydrofurfurylaminofluoran as a colorless electron donor dye, 20 g of zinc 4-β-p-methoxyphenoxyethoxysalicylate as an electron acceptor compound, 20 g of 1,1,3-tris(2-methyl-4-hydroxy-5-tert-butylphenyl)butane as a hindered phenol compound and 20 g of dibenzyl oxalate ester as a sensitizer respectively were dispersed overnight in 100 g of a 5% aqueous solution of polyvinyl alcohol (syndiotacticity, 55 molar %; saponification degree, 98.5 molar %; polymerization degree, 550) with a ball mill to a diameter of 1.5 μm or less, to obtain respective dispersions. 80 g of calcium carbonate was dispersed in 160 g of a 0.54% solution of sodium hexametaphosphate with a homogenizer to obtain a pigment dispersion.

The respective dispersions thus obtained were mixed at a ratio of 5 g of the colorless electron donor dye dispersion, 10 g of the electron acceptor compound dispersion, 3 g of the 1,1,3-tris(2-methyl-4-hydroxy-5-tert-butylphenyl)butane dispersion, 10 g of the dibenzyl oxalate ester dispersion, 5 g of the calcium carbonate dispersion and 3 g of a 21% zinc stearate emulsion, and then a 40% glyoxal solution was added thereto so that a ratio of solid polyvinyl alcohol/neat glyoxal was 10/1 to obtain a coating solution for a thermal-sensitive layer. This coating solution for the thermal-sensitive coloring layer was coated on a high grade paper having weight of 50 g/m$^2$ by using a wire bar so that the dry-state weight of the coated layer was 5 g/m$^2$, by drying at 50° C. for 1 minute to obtain a thermal-sensitive recording paper.

EXAMPLES 2 and 3

The same processes as those in Example 1 were repeated to obtain a thermal-sensitive recording paper, except that polyvinyl alcohols having syndiotacticity of 57 molar % and 61 molar % respectively (both having saponification degree of 98.5 molar % and a polymerization degree of 550) were used in place of the polyvinyl alcohol having syndiotacticity of 55 molar % in Example 1.

EXAMPLES 4 and 5

The same processes as those in Example 1 were repeated to obtain a thermal-sensitive recording paper, except that polyvinyl alcohols having a polymerization degree of 1000 and 1750 respectively were used in place of the polyvinyl alcohol having a polymerization degree of 550 in Example 1.

EXAMPLES 6 to 9

The same processes as those in Example 2 were repeated to obtain a thermal-sensitive recording material, except that syndiotactic polyvinyl alcohol modified with carboxy (itaconic acid, 1 molar %) (Example 6), primary amino group (5 molar %) (Example 7), silanol (5 molar %) (Example 8) or sulfonic acid (2 molar %) (Example 9) were used in place of the unmodified syndiotactic polyvinyl alcohol in Example 2.

EXAMPLE 10

The same processes as those in Example 2 were repeated to obtain a thermal-sensitive recording material, except that syndiotactic polyvinyl alcohol having a saponification degree of 96.0 molar % was used in place of the syndiotactic polyvinyl alcohol having a saponification degree of 98.5 molar % in Example 2.

COMPARATIVE EXAMPLES 1 and 2

The same processes as those in Example 1 were repeated to obtain a thermal-sensitive recording paper, except that polyvinyl alcohols having syndiotacticity of 52.8 molar % and 53.5 molar % respectively were used in place of the polyvinyl alcohol having syndiotacticity of 55 molar % in Example 1.

EXAMPLE 11

(Preparation of a Coating Solution for the Protective Layer)

80 g of aluminum hydroxide (Hisilite H42; manufactured by Showadenko K.K.) was dispersed in 160 g of a 0.54% aqueous solution of sodium hexametaphosphate with a homogenizer. To 40 g of this dispersion were added 600 g of a 25% aqueous solution of the syndiotactic polyvinyl alcohol used in the protective layer in Example 9, 15 g of 40% glyoxal and 183 g of a 40% zinc stearate dispersion (Himicron F930; average diameter 1 to 0.8 μm; manufactured by Chukyoyushi K.K.) to obtain a coating solution for the protective layer. This coating solution for the protective layer was coated on the thermal-sensitive coloring layer of the thermal-sensitive recording paper obtained in Example 9 in a dry-state amount of 3 g/m$^2$ with a wire bar, by drying at 50° C. in an oven to obtain a thermal-sensitive recording material.

EXAMPLE 12

(Preparation of a Capsulation Liquid)

16 g of 2-anilino-3-methyl-6-N-ethyl-N-butylaminofluoran as a coloring agent and 20 g of Takenate D-110N (trade name of a capsule wall forming agent; manufactured by Takedayakuhinkogyo K.K.) were added to a mixed solvent of 20 g of ethyl acetate and 5 g of methylene chloride and dissolved therein. The resulting solution was mixed with 50 g of a 8 wt % aqueous solution of sulfonic acid-modified polyvinyl alcohol as in Example 9, and the mixture thus obtained was mixed with an aqueous phase of 20 g of water and 0.5 g of a 2 wt % aqueous solution of sodium salt of dioctyl sulfosuccinate, followed by emulsification at 10000 rpm for 5 minutes by using an Ace Homogenizer (manufactured by Nihonseiki K.K.). 70 g of water was further added to the resultant emulsion, followed by capsulation reaction at 40° C. for 3 hours to obtain a capsulation liquid having an average diameter of 0.7 μm.

The same processes as those in Example 9 were carried out, except that the capsulation liquid was added in place of the coloring agent liquid in Example 9 at the same solid coloring agent amount, and a 40% aqueous solution of glyoxal was further added so that the ratio of solid sulfonic acid-modified polyvinyl alcohol/neat glyoxal was 10/1. A thermal-sensitive recording material was thereby obtained.

EXAMPLE 13

(Preparation of a Leuco-Dye Dispersed Type Thermal-Sensitive Recording Material)

20 g of 2-anilino-3-methyl-6-N-ethyl-N-tetrahydrofurfurylaminofluoran as a colorless electron donor dye which is a coloring agent, 20 g of zinc 4-β-p-methoxyphenoxyethoxysalicylate as an electron acceptor compound which is a color former, 20 g of 1,1,3-tris(2-methyl-4-hydroxy-5-tert-butylphenyl)butane as a hindered phenol compound and 20 g of dibenzyl oxalate ester as a sensitizing agent were respectively dispersed overnight in 100 g of a 5% aqueous solution of polyvinyl alcohol (ethylene-modified polyvinyl alcohol; RS-106; manufactured by Kurarey K.K.; syndiotacticity, 59.3 molar %; ethylene-modified rate, 10 molar %; saponification degree, 98.8 molar %; polymerization degree, 590) with a ball mill to an average diameter of less than or equal to 1.5 μm to obtain respective dispersions. Separately, 80 g of calcium carbonate was dispersed in 180 g of a 0.5% solution of sodium hexametaphosphate by an Ace Homogenizer (manufactured by Nihonseiki K.K.) to obtain a pigment dispersion.

The respective dispersions thus obtained were mixed at a ratio of 5 g of the colorless electron donor dye (coloring agent) dispersion, 10 g of the electron acceptor compound (color former) dispersion, 3 g of the 1,1,3-tris(2-methyl-4-hydroxy-5-tert-butylphenyl)butane dispersion, 10 g of the dibenzyl oxalate ester dispersion, 5 g of the calcium carbonate dispersion and 3 g of the 21% zinc stearate emulsion to obtain a coating solution for a thermal-sensitive recording layer. This coating solution for a thermal-sensitive coloring layer was coated on a high grade paper having a weight of 50 g/m$^2$ with a wire bar so that the dry-state weight of the coated layer was 5 g/m$^2$, by drying at 50° C. for 1 minute to obtain a thermal-sensitive recording paper.

EXAMPLE 14

(Preparation of a Leuco-Dye-Containing Capsule Type Thermal-Sensitive Recording Material)

16 g of 2-anilino-3-methyl-6-N-ethyl-N-butylaminofluoran and 20 g of Takenate D110N (multifunctional isocyanate; material for preparation of capsule; manufactured by Takedayakuhinkogyo K.K.) were added to a mixed solvent of 20 g of ethyl acetate and 5 g of methylene chloride and were dissolved therein. The resultant solution was mixed with an aqueous phase of a mixture of 50 g of a 8 wt % was aqueous solution of ethylene-modified polyvinyl alcohol as in Example 13 and 0.5 g of a 2 wt % aqueous solution of sodium of dioctyl sulfosuccinate, and the mixture thus obtained was emulsified at 10000 rpm for 5 minutes by an Ace Homogenizer. 70 g of water was further added to the resulting emulsion, followed by capsulation reaction at 40° C. for 3 hours to obtain a capsulation liquid having an average diameter of 0.7 μm.

The same processes as those in Example 13 were repeated to obtain a thermal-sensitive recording material, except that the above capsulation liquid was added in place of the colorless electron donor dye dispersion in Example 13 at the same solid coloring agent amount.

EXAMPLE 15

(Preparation of a Diazonium Salt/Coupler Coloring Type Thermal-Sensitive Recording Material)

(Preparation of a Diazonium Salt Compound Capsulation Liquid)

2.8 parts of a compound having the maximum absorption wavelength for degradation at 365 nm and shown by following formula a-1 and serving as a diazonium salt compound, 2.8 parts of dibutyl sulfate and 0.56 part of 2,2-dimethoxy-1,2-diphenylethane-1-one (Ilgacure 651; trade name; manufactured by Ciba Geigy) were dissolved in 19.0 parts of ethyl acetate. 5.9 parts of isopropylbiphenyl which is a high boiling point solvent and 2.5 parts of tricresyl phosphate were added to the above solution and the mixture was heated and uniformly mixed. 7.6 parts of xylylenediisocyanate/trimethylolpropane adduct (75% solution in ethyl acetate; trade name: Takenate D110N; manufactured by Takedayakuhinkogyo K.K.) as a capsule wall forming agent was added to the solution and uniform stirring was carried out. Separately, 64 parts of 6 wt % aqueous solution of ethylene-modified polyvinyl alcohol (RS-106) into which 2.0 parts of a 10 wt % aqueous solution of sodium dodecyl sulfonate was added was prepared. To this solution was added the above diazonium salt compound solution, followed by emulsion-dispersion with a homogenizer. 20 parts of water was added to the resulting emulsion which was then homogenized. Thereafter, the temperature was raised to 40° C. while stirring, followed by capsulation reaction for 3 hours. Thereafter, the temperature was lowered to 85° C., and 6.5 parts of an ion-exchange resin Amberlite IRA68 (manufactured by Organo) and 13 parts of Amberlite IRC50 (manufactured by Organo) were added thereto, and the mixture was further stirred for 1 hour. Thereafter, the ion-exchange resins were filtered to obtain a capsulation liquid. The average diameter of the capsule was 0.64 μm.

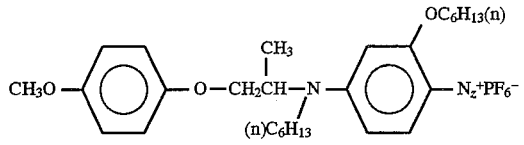

(Preparation of a Coupler Emulsion Dispersion)

3.0 parts of a compound b-1 shown below and serving as a coupler, 4.0 parts of triphenylguanidine, 4.0 parts of 1,1-(p-hydroxyphenyl)-2-ethylhexane, 8.0 parts of 4,4'-(p-phenylenediisopropylidene)diphenol, 8.0 parts of 2-ethylhexyl-4-hydroxybenzoate, 2.0 parts of b-2 as an antioxidant and 2.0 parts of 1,1,3-tris(2-methyl-4-hydroxy-5-tert-butylphenyl)butane were dissolved in 10.5 parts of ethyl acetate. 0.48 part of tricresyl phosphate which is a high boiling point solvent, 0.24 part of diethyl maleate and 1.27 parts of Pionin A41C (manufactured by Takemotoyushi K.K.) were added thereto, followed by heating and uniform mixing. The prepared mixture was added to 93 parts of a 8 wt % aqueous solution of ethylene-modified polyvinyl alcohol (RS-106), followed by emulsion-dispersion by a homogenizer. The remaining ethyl acetate was evaporated from this emulsion to obtain an emulsion dispersion.

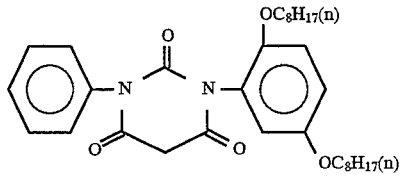

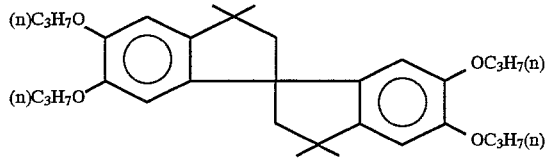

(Preparation of a Coating Solution)

The above diazonium salt compound capsulation liquid, a coupler emulsion dispersion and a styrene-butadiene rubber (SBR:SN307; manufactured by Sumitomo Nogatac K.K.) were mixed at a ratio of diazonium salt compound/coupler=1/2 and a ratio of diazonium salt compound/styrene-butadiene rubber=1/6.4 to obtain a coating solution. This coating solution was coated in a similar manner as that in Example 13 to obtain a thermal-sensitive recording paper.

EXAMPLE 16

(Preparation of an Organic Silver Salt/Reducing Agent Type Thermal-Sensitive Recording Material)

Preparation of Silver Behenate 8.53 g of behenic acid was added to 200 g of water. The solution was warmed to 90° C., and an aqueous solution of 1.0 g of NaOH dissolved in 25 g of water was added thereto, followed by cooling to 50° C. Then, an aqueous solution of 4.3 g of $AgNO_3$ dissolved in 25 g of water was added to the resultant solution dropwise over 1.5 hours and reacted.

The resultant reaction solution was added to a mixed liquid of water and isopropanol at a wt ratio of 1/1 and stirred, followed by centrifugation. These procedures were repeated three times and the resulting solid was dried by blast for two days and nights at ordinary temperature to obtain silver behenate having a moisture content of 0.5%. Instead of drying by blast, the solid may be dehydrated with isopropanol/butyl acetate and then centrifuged.

Preparation of a Coating Solution for a Recording Layer (Preparation of a Silver Behenate-Containing Capsule)

7.6 g of the silver behenate thus obtained, 20.0 g of n-butyl acetate, 5.0 g of isopropylalcohol and 2.0 g of poly(vinyl butyral) were uniformly mixed and dispersed at 10000 rpm for 2 hours by a homogenizer. 8.0 g of Takenate D-110N (capsule wall forming agent) was added to the resulting dispersion.

The resulting silver behenate solution was added to a solution (aqueous phase) obtained by mixing 40 g of a 6% aqueous solution of ethylene-modified polyvinyl alcohol (RS-106) and 0.3 g of a 2% aqueous solution of sodium dioctyl sulfosuccinate, followed by emulsion-dispersion at 8000 rpm for 10 minutes by a homogenizer.

15 g of water was added to the resulting emulsion dispersion, and uniform mixing was carried out. The mixture was heated to 40° C. while stirring, followed by capsulation reaction for 3 hours to an average capsule diameter of 10 μm to obtain a silver behenate-containing capsulation liquid.

(Preparation of a Color Former Emulsion-Dispersion)

0.5 g of bisphenol B, 5 g of propyl gallate, 3 g of phthalazinone (development accelerating agent), 0.2 g of benzoxazinedione, 2 g of tribromomethylbenzimidazole, 4 g of ethyl acetate, 3 g of methyl cellosolve, 3 g of tetrahydrofuran and 0.5 g of tricresyl phosphate were uniformly mixed.

The resulting developing liquid was added to a mixed solution of 15 g of a 10% aqueous solution of ethylene-modified polyvinyl alcohol (RS-106), 1 g of a 1% aqueous solution of sodium benzenethiosulfonate and a 6% aqueous solution of sodium dodecylbenzenesulfonate, followed by emulsion-dispersion at 10000 rpm for 10 minutes by a homogenizer.

Ethyl acetate, methyl cellosolve and tetrahydrofuran were evaporated off from the resulting emulsion-dispersion to obtain a developing emulsion dispersion having a particle diameter of 0.6 μm.

(Preparation of a Coating Solution)

30 g of the prepared silver behenate-containing capsulation liquid and 10 g of the developing agent emulsion-dispersion were mixed to obtain a coating solution which was coated in a similar manner as that as in Example 13 to obtain a thermal-sensitive recording material.

EXAMPLES 17 to 20

(Preparation of a Coating Solution for a Protecting Layer)

80 g of aluminum hydroxide (Hisilite H42; manufactured by Showadenko K.K.) was dispersed in 160 g of a 0.5% aqueous solution of sodium hexametaphosphate by a homogenizer. To 40 g of this dispersion were added 600 g of a 15% aqueous solution of ethylene-modified polyvinyl alcohol (RS-106) and 183 g of a 40% zinc stearate dispersion (Himicron F930; manufactured by Chukyoyushi K.K.; average particle diameter, 1 to 0.8 μm) to obtain a coating solution for a protective layer. This coating solution for a protective layer was coated on the respective thermal-sensitive coloring layers of the thermal-sensitive recording materials obtained in Examples 13 to 16 with a wire bar, by drying at 50° C. in an oven to obtain thermal-sensitive recording materials at a dry-state coating amount of 3 g/m$^2$ of Examples 17 to 20, respectively.

EXAMPLES 21 to 22

Coating solutions for a protective layer were prepared in accordance with the same processes as those of Examples 17 to 20, except that ethylene-modified polyvinyl alcohol (RS-110; manufactured by Kurarey K.K.; ethylene modified rate, 5 molar %; polymerization degree, 1000, saponification degree, 98.8 molar %) (Example 21) and ethylene-modified polyvinyl alcohol (RS-117H; manufactured by Kurarey K.K.; syndiotacticity, 55.5 molar %; ethylene modified rate, 5 molar %; polymerization degree, 1750, saponification degree, 99.3 molar %) (Example 22) were respectively used in place of the ethylene-modified polyvinyl alcohol (RS-106) which was used for the preparation of the coating solution for a protective layer in Examples 17 to 20. The resultant coating solutions were coated on the thermal-sensitive recording material obtained in Example 15 to obtain thermal-sensitive recording materials of Examples 21 and 22, respectively.

EXAMPLE 23

The same processes as those in Examples 17 to 20 were repeated to obtain a coating solution for a protective layer, except that unmodified polyvinyl alcohol (PVA105: manufactured by Kurarey K.K.; syndiotacticity, 53.3 molar %) was used in place of the ethylene-modified polyvinyl alcohol used for preparation of the coating solution for a protective layer in Examples 17 to 20. The resultant coating solution for a protective layer was coated on the thermal-sensitive recording material obtained in Example 15 to obtain a thermal-sensitive recording material of Example 23.

EXAMPLE 24

A thermal-sensitive recording material of Example 24 was obtained by the same processes as those of Example 19, except that unmodified polyvinyl alcohol (PVA105) was used in place of the ethylene-modified polyvinyl alcohol (RS-106) in the diazonium salt compound capsulation liquid and the coupler emulsion-dispersion in Example 19.

EXAMPLES 25 AND 26

Thermal-sensitive recording materials of Examples 25 and 26 were obtained by the same processes as those of Examples 19 and 20 respectively, except that a 40% glyoxal solution was added so that a ratio of solid ethylene-modified polyvinyl alcohol/neat glyoxal was 10/1.

EXAMPLES 27 and 28

Thermal-sensitive recording materials of Examples 27 and 28 were obtained by the same processes as those in Examples 17 and 18 respectively, except that a 40% glyoxal solution was further added to the coating solution for a protective layer in Example 17 and 18.

COMPARATIVE EXAMPLES 3 AND 4

Thermal-sensitive recording materials of Comparative Examples 3 and 4 were obtained by the same processes as those of Examples 13 and 14 respectively, except that unmodified polyvinyl alcohol (PVA105) was used in place of the ethylene-modified polyvinyl alcohol (RS-106) in Examples 13 and 14.

COMPARATIVE EXAMPLES 5 AND 6

Thermal-sensitive recording materials of Comparative Examples 5 and 6 were obtained by the same processes as those of Examples 19 and 20 respectively, except that unmodified polyvinyl alcohol (PVA105) was used in place of the ethylene-modified polyvinyl alcohol (RS-106) in Examples 19 and 20.

COMPARATIVE EXAMPLE 7

A thermal-sensitive recording material of Comparative Example 7 was obtained by the same processes as those of Examples 19, except that the saponification degree of the ethylene-modified polyvinyl alcohol was 80 molar %.

COMPARATIVE EXAMPLE 8

The same processes as those of Example 19, with the exception that the ethylene-modified rate of the ethylene-modified polyvinyl alcohol was 25 molar %, were repeated in an attempt to obtain a thermal-sensitive recording material of Comparative Example 8. However, since this polyvinyl alcohol has a low water-solubility, the respective homogeneous dispersions could not be prepared.

The respective surfaces of the thermal-sensitive recording materials obtained in the Examples and the Comparative Examples were treated by calendering to adjust the smoothness prescribed in JIS-8119 to 500±50 seconds to obtain thermal-sensitive recording materials.

(Test Procedures and Evaluation Method)

The respective surfaces of the thermal-sensitive recording materials thus obtained were treated by calendering to adjust the smoothness prescribed in JIS-8119 to 500±50 seconds to obtain thermal-sensitive recording materials.

Water Resistance

Printing was carried out on the respective thermal-sensitive recording material samples by using a test printer manufactured by Kyosera K.K. Water was applied to the samples and the samples were laminated together. The samples were then dried and peeled, and the state of the coated layer was observed and evaluated and given one of the following five grades: (A) no change is observed in the coated layer, (B) nearly almost all of the coated layer remains, (C) the coated layer is slightly removed but the printed letters can be read, (D) the coated layer is removed and the printed letters can barely be read, (E) the coated layer is considerably removed and the printed letters cannot be read. Only thermal-sensitive recording materials receiving grades of (A) to (C) can be used in actuality.

Resistance to Chemicals

Printing was carried out on the respective thermal-sensitive recording material samples by using a test printer manufactured by Kyosera K.K. A finger uniformly coated with a hand cream contacted the printed part. The state of the contacted part was observed and evaluated and given one of the following four grades: (A) no change is observed in the printed part, (B) a slight change in the printed part is observed but the printed letters can be read, (C) blurring and disappearance of color are observed and the printed letters can barely be read, (D) blurring and disappearance of color are marked and printed letters cannot be read. Only thermal-sensitive recording materials receiving grades of (A) and (B) can be used in actuality.

Running Properties

Printing was carried out on the respective thermal-sensitive recording material samples by using a test printer manufactured by Kyosera K.K., and the degree of to which sticking occurred was evaluated and given one of the following four grades: (A) no occurrence, (B) unevenness of printing is observed but non-printed part is not observed, (C) a small non-printed part is observed, (D) white streaks are observed on the whole surface. Only thermal-sensitive recording materials receiving grades of (A) and (B) can be used in actuality.

Test samples were subjected to moisture conditioning 1 hour or more at 23° C. and 65% RH atmosphere, and the above evaluations were performed. The results thereof are shown in Tables 1 and 2. In the respective experiments, the coating solution for a protective layer did not gelatinize and could be coated stably for more than 1 day. Therefore, the present recording materials had excellent manufacturing applicability.

TABLE 1

| | Water resistance | Running properties | Resistance to chemicals |
|---|---|---|---|
| Example 1 | C | A | B |
| Example 2 | B | A | A |
| Example 3 | A | A | A |
| Example 4 | B | A | A |
| Example 5 | A | A | A |
| Example 6 | B | A | A |
| Example 7 | B | A | A |
| Example 8 | B | A | B |
| Example 9 | B | A | A |
| Example 10 | B | A | B |
| Comp. Ex. 1 | D | C | D |
| Comp. Ex. 2 | D | C | D |
| Example 11 | A | A | A |
| Example 12 | B | A | A |

From the results in Table 1, it is clear that recording materials using a polyvinyl alcohol having syndiotacticity of less than 55 molar % have inferior running properties and resistance to chemicals and, in particular, have extremely low water resistance. On the other hand, the present recording materials using a polyvinyl alcohol having syndiotacticity of greater than or equal to 55 molar % have better water resistance, resistance to chemicals and running properties.

TABLE 2

| | Water resistance | Running properties | Resistance to chemicals |
|---|---|---|---|
| Example 13 | C | A | C |
| Example 14 | B | A | B |
| Example 15 | B | A | B |
| Example 16 | B | A | B |
| Example 17 | A | A | B |
| Example 18 | A | A | B |
| Example 19 | A | A | B |
| Example 20 | A | A | B |
| Example 21 | A | A | B |
| Example 22 | A | A | A |
| Example 23 | B | A | B |
| Example 24 | C | A | B |
| Example 25 | A | A | A |
| Example 26 | A | A | A |
| Example 27 | B | A | A |
| Example 28 | B | A | A |
| Comp. Ex. 3 | D | C | D |
| Comp. Ex. 4 | D | C | D |
| Comp. Ex. 5 | D | B | D |
| Comp. Ex. 6 | D | B | D |
| Comp. Ex. 7 | B | B | D |
| Comp. Ex. 8 | — | — | — |

* In Comparative Example 8, since the polyvinyl alcohol did not dissolve in water, a sample could not be prepared.

From the results in Table 2, it is clear that recording materials using an ethylene-modified polyvinyl alcohol having ethylene-modified rate of less than or equal to 20 molar % and a saponification degree of greater than or equal to 85 molar % have excellent water resistance, resistance to chemicals and running properties.

As described above, in accordance with the present invention, there can be obtained a recording material having high water resistance, having no sticking on the surface thereof and having excellent running properties and better resistance to chemicals, at temperatures at which the properties of the coloring substance are not adversely affected.

What is claimed is:

1. A recording material provided with, on a support, at least a coloring layer containing a first coloring component which is substantially colorless and a second coloring component which is substantially colorless and is colored by reacting with the first coloring component, and a protective layer provided on the coloring layer and having a pigment and a binder as main components, wherein at least the protective layer contains a polyvinyl alcohol resin having syndiotacticity of greater than or equal to 55 molar % as diad indication and a saponification degree of greater than or equal to 85 molar %.

2. The recording material according to claim 1, wherein the polyvinyl alcohol resin is a random copolymer in which a ratio of vinyl alcohol monomer component of polyvinyl alcohol and ethylene monomer is 80:20–99:1.

3. The recording material according to claim 1, wherein the protective layer contains, in addition to the polyvinyl alcohol resin, a cross-linking agent for cross-linking the polyvinyl alcohol resin.

4. The recording material according to claim 3, wherein the cross-linking agent is selected from the group consisting of epoxy compounds, blocked isocyanates, vinylsulfone compounds, aldehyde compounds, methylol compounds, boric acid, carboxylic acid anhydrides, silane compounds, chelating compounds and halogenated compounds.

5. The recording material according to claim 4, wherein the combination of the first coloring component and the second coloring component is at least one of the following combinations:

(i) combination of a photodegradable diazo compound and a coupler, (ii) combination of an electron donor dye precursor and an electron acceptor compound, (iii) combination of an organic metal salt and a reducing agent.

6. The recording material according to claim 5, wherein the photodegradable diazo compound is represented by the following structure a-1 and the coupler is represented by the following structure b-1.

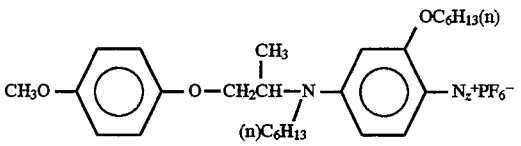

a-1

-continued

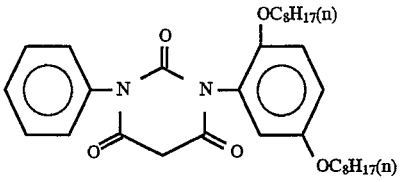

b-1

7. The recording material according to claim 1, wherein a combination of the first coloring component and the second coloring component is at least one of the following combinations:

(i) combination of a photodegradable diazo compound and a coupler, (ii) combination of an electron donor dye precursor and an electron acceptor compound, (iii) combination of an organic metal salt and a reducing agent, (iv) combination of a long-chain fatty acid salt and phenol, (v) combination of a heavy metal salt of an organic acid and an alkaline earth metal sulfide, or combination of a heavy metal salt of an organic acid and an organic chelating agent, (vi) combination of a heavy metal sulfate and a sulfur compound, (vii) combination of a ferric salt of a fatty acid and an aromatic polyhydroxy compound, (viii) combination of a metal salt of an organic acid and an organic polyhydroxy compound, (ix) combination of a ferric salt of a fatty acid and a thiocetylcarbamide or an isothiocetylcarbamide derivative, (x) combination of a lead salt of an organic acid and a thiourea derivative, (xi) combination of a heavy metal salt of a higher fatty acid and zinc dialkyldithiocarbamate, (xii) combination of resorcin and a nitroso compound, which forms an oxazine dye, and (xiii) combination of a formazane compound and a reducing agent and/or a metal salt.

* * * * *